US006242856B1

(12) United States Patent
Harberts et al.

(10) Patent No.: US 6,242,856 B1
(45) Date of Patent: Jun. 5, 2001

(54) CATHODE RAY TUBE COMPRISING A DEFLECTION UNIT

(75) Inventors: Dirk W. Harberts; Hendrik D. Van Den Berg, both of Eindhoven; Robert T. M. Doedee, Oisterwijk, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/332,210

(22) Filed: Jun. 14, 1999

(30) Foreign Application Priority Data

Jun. 17, 1998 (EP) ..... 98202024

(51) Int. Cl.[7] ..... H01J 29/74

(52) U.S. Cl. ..... 313/439; 313/432

(58) Field of Search ..... 313/412, 413, 313/414, 426, 432, 434, 440; 335/210, 212, 213; 315/224, 364, 370, 379

(56) References Cited

U.S. PATENT DOCUMENTS 5,039,922 * 8/1991 Ogasa et al. ..... 315/370

* cited by examiner

*Primary Examiner*—Vip Patel

(57) ABSTRACT

A cathode ray tube includes a deflection unit. A coil system of the deflection unit is provided with a conductive layer, the value for $f_{max}/\Delta f$ ranging between 0.5 and 10, $\Delta f$ being the half-value width of the impedance curve around a peak frequency $f_{max}$, and $f_{max}$ being greater that 1 MHz. This results in a reduction of ringing phenomena.

7 Claims, 5 Drawing Sheets

CATHODE RAY TUBE COMPRISING A DEFLECTION UNIT

BACKGROUND OF THE INVENTION

The invention relates to a cathode ray tube comprising an electron gun, a display screen and a deflection unit for deflecting the electron beam, which deflection unit includes a line deflection coil system and a frame deflection coil system.

The invention also relates to a deflection unit for use in a cathode ray tube.

Cathode ray tubes are employed, inter alia, in display devices such as television receivers, computer monitors and oscilloscopes.

In operation, the means for generating an electron beam generates one or more electron beams. The deflection unit generates electromagnetic fields for deflecting the electron beam (or electron beams) across a display screen in two mutually perpendicular directions. These directions are commonly referred to as the line direction (generally the horizontal direction) in which direction the display screen is scanned at a relatively high frequency, and the frame direction (generally the vertical direction) in which direction the display screen is scanned at a relatively low velocity. During deflection of the electron beam(s), a phenomenon occurs which will hereinafter be referred to as "ringing". A sudden change of the magnetic deflection field generated by the line deflection coil system causes an excitation of the line deflection coil system and/or the frame deflection coil system. This phenomenon occurs, in particular, during flyback of the line deflection and causes a deviation in the frame deflection direction on a line written in the line deflection direction and/or in the velocity at which a line is written in the line deflection direction. This deviation is visible, in particular, in an area at the edge of the display screen, that is the location where line scanning of the display screen starts.

A known measure for reducing this problem is a so-called overscan of the display screen. An overscan of the display screen means that line scanning starts some distance beyond the display screen. As a result thereof, ringing is not reduced but the consequences of this phenomenon are less visible or invisible on the display screen. This measure has the drawback that the velocity at which information is displayed on the display screen is increased and that the electron beam(s) must be deflected through a larger angle, so that more energy has to be supplied to the deflection system.

SUMMARY OF THE INVENTION

It is an object of the invention to reduce "ringing" without the above-mentioned drawbacks.

To achieve this, a cathode ray tube in accordance with the invention is characterized in that the line deflection coils are at least partly provided with a conductive layer, and the impedance of the line deflection coil system exhibits a maximum at a frequency $f_{max}$ of more than 1 MHz, and in that $f_{max}/\Delta f$ ranges between 0.5 and 10, $\Delta f$ being the width of the impedance curve around $f_{max}$ at a value equal to $1/\sqrt{2}$ of the peak value and/or in that the frame deflection coils are at least partly provided with a conductive layer, and the impedance of the frame deflection coil system exhibits a maximum at a frequency fmax of more than 0.3 MHz, and in that $f_{max}/\Delta f$ ranges between 0.5 and 10.

The invention is based on the fact that the application of a conductive layer to (a part of) the line deflection coil system and/or the frame deflection coil system may have a positive effect on the "ringing" phenomenon. The line deflection coil system as well as the frame deflection coil system can be regarded as a resonance circuit with a natural frequency. The impedance is frequency-dependent and exhibits a maximum at or around the natural frequency of the resonance circuit. The steeper the slope of the resonance characteristic, the more "ringing" occurs. A measure of the slope of the resonance characteristic is the width of the resonance peak, that is $f_{max}/\Delta f$, where $f_{max}$ is the frequency at which the impedance exhibits a maximum and $\Delta f$ is the width of the impedance curve around the maximum. These quantities result from a measurement of the impedance of the line deflection coil system as a function of the frequency. $f_{max}/\Delta f$ is large for (almost) undamped resonance circuits and low for heavily damped resonance circuits. For customary line deflection coil systems, $f_{max}/\Delta f$ is greater than 10, typically approximately 20, at a natural frequency in the range between 1.5 and 6 MHz. The values for an $f_{max}/\Delta f$ frame deflection coil system are comparable; the value of the natural frequency ranges between 0.4 and 1 MHz. The application of a conductive layer reduces the value of $f_{max}/\Delta f$, so that resonances in the line deflection coil system are damped more rapidly, which reduces ringing. However, the application of a conductive layer also has a further effect, namely that the natural frequency of the resonance circuit formed by the line deflection coil system and/or frame deflection coil system is reduced. The invention is also based on the realization that this second effect may have an opposite result, namely an increase of "ringing" phenomena. As the natural frequency of the line deflection coil system and/or frame deflection coil system is reduced, the time necessary to damp vibrations in this system is increased. In addition, the distance (in frequency) between the natural frequency of the line deflection coil system and frequencies of other resonance circuits (such as the frame deflection coil system) and of stresses generated during operation in the cathode ray tube (such as the line frequency and harmonics thereof) are reduced, which generally increases the risk of crosstalk between resonances (and hence of ringing). By ensuring that the natural frequency of the line deflection coil system is above 1 MHz and/or the natural frequency of the frame deflection coil system is more than 0.3 MHz, the above-mentioned negative effects caused by the application of a conductive layer remain much smaller than the positive effects. If the natural frequency is smaller than 1 MHz, ringing generally increases. Hereinabove, the invention has been explained by means of the effects on a line deflection coil system. The same applies for a frame deflection coil system.

Preferably, $f_{max}/\Delta f$ ranges between 1 and 5. In this case, damping is very effective without the natural frequency being influenced to a substantial degree. A reduction of the value of $f_{max}/\Delta f$ also has the effect that the dissipation in the coil is increased, which increase in dissipation is acceptable for values ranging between 1 and 5.

These and other aspects of the invention will be apparent from and elucidated with reference to the embodiments described hereinafter.

DESCRIPTION OF THE PREFERRED EMBODIMENTS

Figure 1:
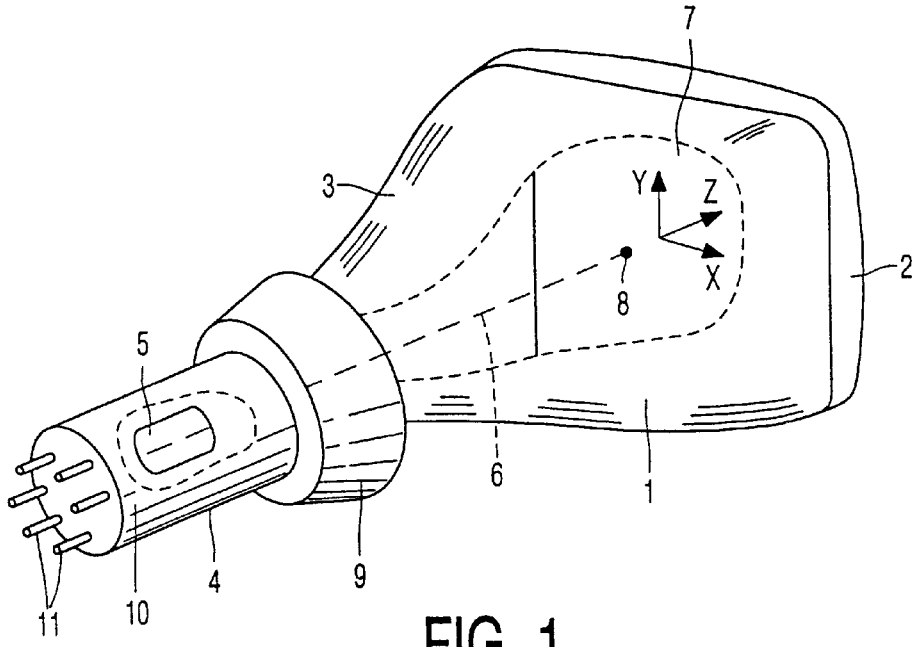
FIG. 1 is a perspective, partly cut-away view of a cathode ray tube.

The Figures are diagrammatic and not drawn to scale, and in the different embodiments like reference numerals generally refer to like parts.

FIG. 1 is a partly cut-away perspective view of a cathode ray tube, for example a 110° monochrome monitor. The invention can also be used in color monitors and (color) television receivers. The cathode ray tube comprises a glass envelope 1 which includes a display window 2, a cone 3 and a neck 4. Said neck accommodates an electron gun 5. The term "electron gun" is to be taken to mean within the scope of the invention a means for generating one or more electron beams. The electron beam 6 is focused to a spot 8 on a display screen 7. The electron beam 6 is deflected across the display screen 7 in two mutually perpendicular directions x, y by means of deflection unit 9. The tube is provided with a base 10 having connections 11. In the Figure, the x and y-directions are indicated, as well as the z-direction which extends at right angles to the x and the y-direction.

Figure 2A:
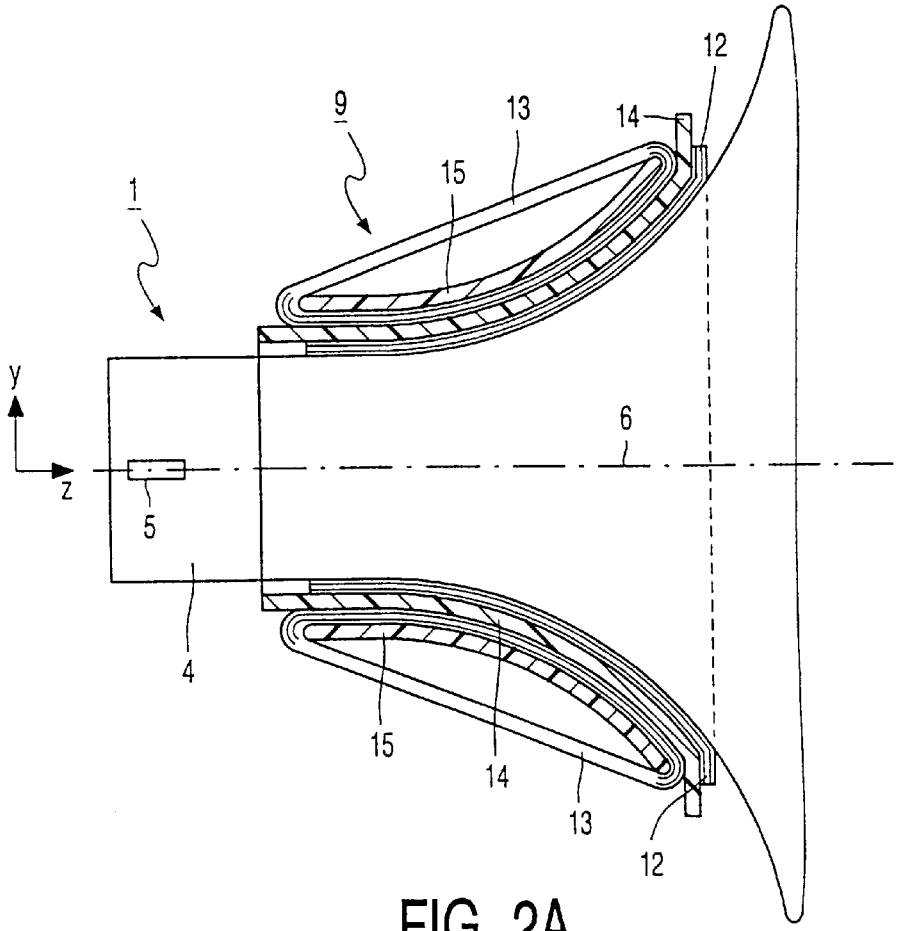
FIG. 2A is a sectional view of a deflection unit for a cathode ray tube.
Figure 2B:
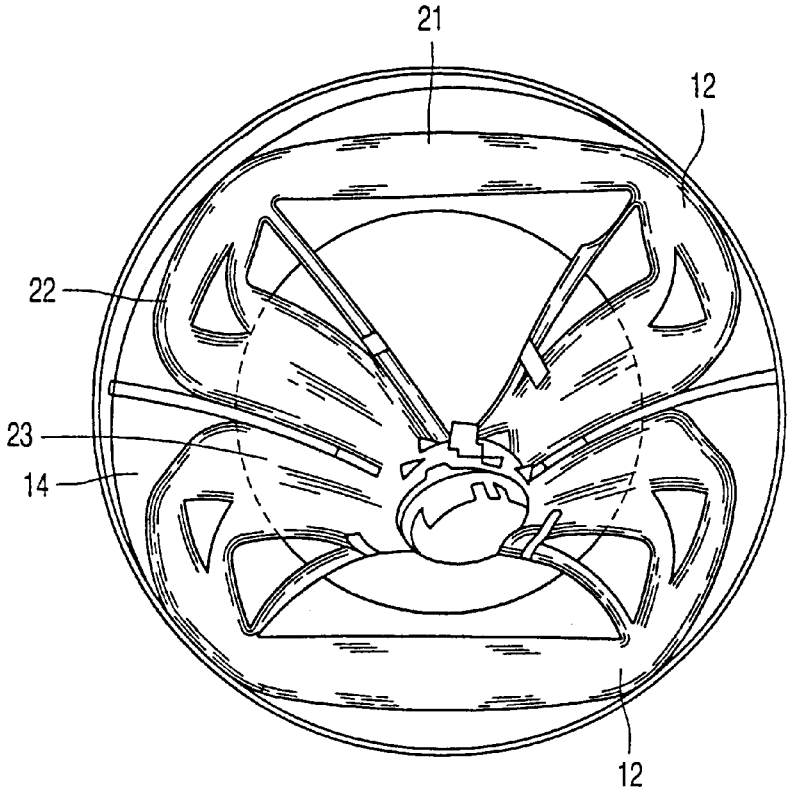
FIG. 2B is a front view of a deflection unit for a cathode ray tube.

A sectional view along the y-direction of an example of a deflection unit 9 is shown in FIG. 2A. The deflection unit comprises a line deflection coil system 12 for deflecting the electron beam in the line deflection direction (the x-direction) and a frame deflection coil system for deflecting the electron beam in the frame deflection direction (the y-direction). In this example, the line deflection coil system 12 includes two saddle-shaped coils and the frame deflection coil system 13 includes a toroidal coil. A support 14 is situated between the systems 12 and 13. Said toroidal coil is wound on a core 15. This example is not to be construed as limiting the scope of the invention. The deflection coil systems may be of the saddle-shaped type, the toroidal type or of any other type. FIG. 2B shows a front view of the deflection unit. The line deflection coil system includes two line deflection coils 12. These coils have flange portions extending more or less transversely to the electron beams. Said flange portions comprise, inter alia, a central portion 21 and outermost portions 22. The line deflection coils further include portions 23 which extend approximately parallel to the cone.

Figure 3:
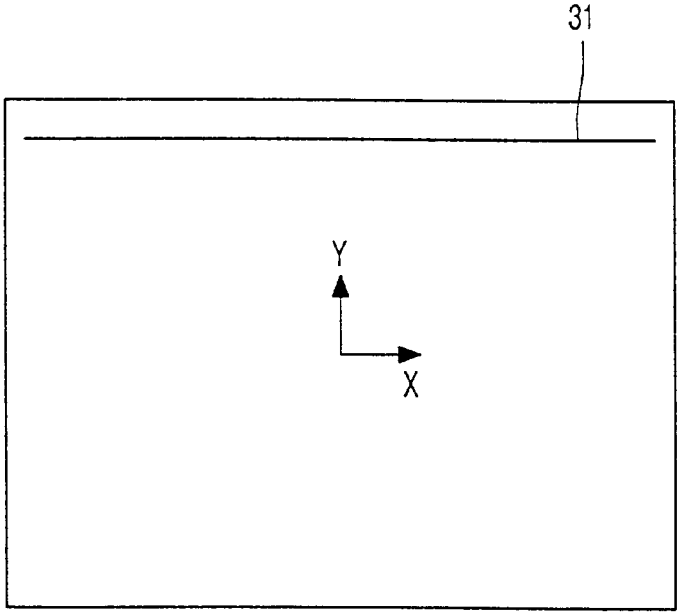
FIG. 3 is a front view of a display screen.

The screen is scanned in a large number of lines. The line deflection coil system 12 deflects the electron beam in the x-direction. Each time, one line, for example line 31 shown in FIG. 3, is scanned. After line 31 has been scanned, the electron beam is rapidly brought to the start of the next line. This return of the electron beam is referred to as line flyback. The frame deflection coil system 13 deflects the electron beam in the y-direction. The line flyback causes an excitation in the frame deflection coil system 13 and/or in the line deflection coil system 12.

Figure 4A:
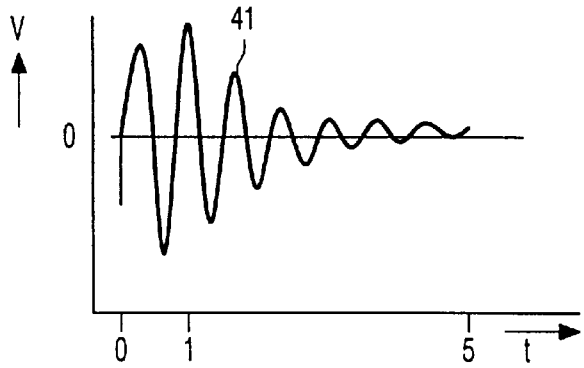
FIG. 4A graphically shows the voltage across the frame deflection coil system immediately after line flyback.
Figure 4B:
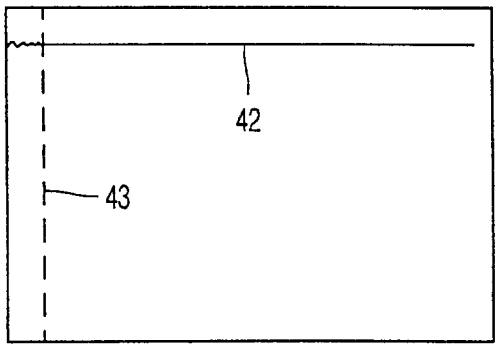
FIG. 4B is a front view of a display screen.
Figure 4C:
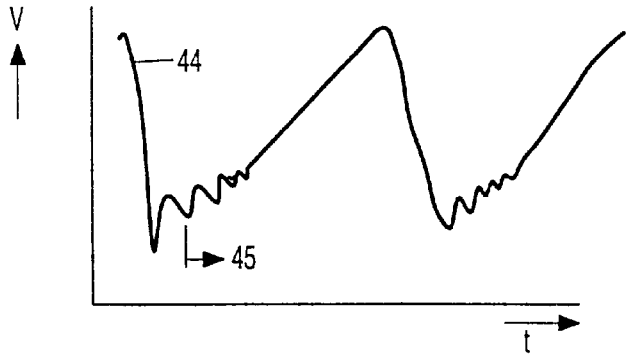
FIG. 4C graphically shows the voltage across the line deflection coil immediately after line flyback.
Figure 4D:
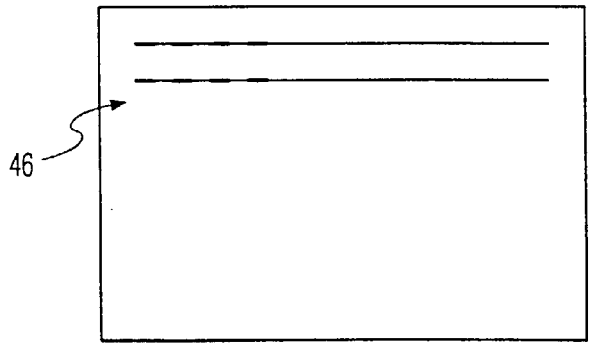
FIG. 4D is a front view of a display screen.

FIGS. 4A and 4B schematically show the effect of an excitation of the frame deflection coil system. During line flyback, the electromagnetic field generated by the line deflection coil system 12 changes in a very short period of time. As a result, a voltage is induced in the frame deflection coil system causing a current to flow through the frame deflection coil system, so that an electromagnetic interference field is generated which deflects the electron beam in the y-direction. Line 41 in FIG. 4A represents the voltage across the frame deflection coil immediately after line flyback. In FIG. 4A, the voltage V is plotted on the vertical axis and the time t in $\mu$sec is plotted on the horizontal axis, where t=0 represents the line flyback. Line 41 exhibits an approximately sinusoidal deviation at the start of the flyback, that is immediately after the line flyback; the amplitude of the deviation decreases with time. FIG. 4B shows the effects of the induced voltage V in the frame deflection coil system on a line in the image represented. A deviation occurs at the beginning of a line 42 written in the line direction. Said line 42 is not straight but undulated. The disturbance is invisible to an observer if the deflection of the electron beam immediately after line flyback is such that the electron beam falls beside the visible part of the display screen. In this case, for example, the visible part of the display screen starts at line 43. Although this solves the problem, the solution is far from ideal. The speed at which information can be represented on the display screen is reduced because, during a part of the time, the electron beam does not scan the visible part of the display screen. The electron beam must be deflected further, which requires additional energy. The higher the line frequency the longer, in general, the part of the line 42 is for which the deviation is visible. For HDTV (High Definition television) and for monitors having a high resolution, the aim is to increase the line frequency. It is an object of the invention to provide a cathode ray tube in which ringing of the frame deflection coil system is reduced. FIG. 4C schematically shows the disturbing ringing effect on the voltage across the line deflection coil system. Immediately after the line flyback 44, the voltage across the line deflection coil system exhibits deviations 45. As a result of these deviations, the speed at which the lines are written on the screen varies, which becomes visible as a pattern of stripes 46, as schematically shown in FIG. 4D.

In a combination of a line and a frame deflection coil system, "ringing" may develop in various ways. If oscillating currents develop in the line deflection coils after the line flyback, this is referred to as line coil ringing, if the oscillating currents develop in the frame deflection coils, this is referred to as frame coil ringing. Also combinations thereof may occur. The invention is based on the realization that these oscillations are largely determined by the resonance behavior of the line and the frame deflection coil system. This resonance behavior can be measured by measuring the impedance of the relevant coil systems as a function of the frequency. These curves exhibit a peak value at a number of natural frequencies, the lowest natural frequency being the most important. The ratio $f_{max}/\Delta f$ is a measure of the amplitude and the damping time of the oscillations. The higher this ratio, the more disturbing the ringing phenomena are. This ratio can be reduced by applying a conductive layer, however, in accordance with a further realization, the natural frequency should not be reduced to a value below 1 MHz because the ringing phenomena increase again below said value.

Figure 5:
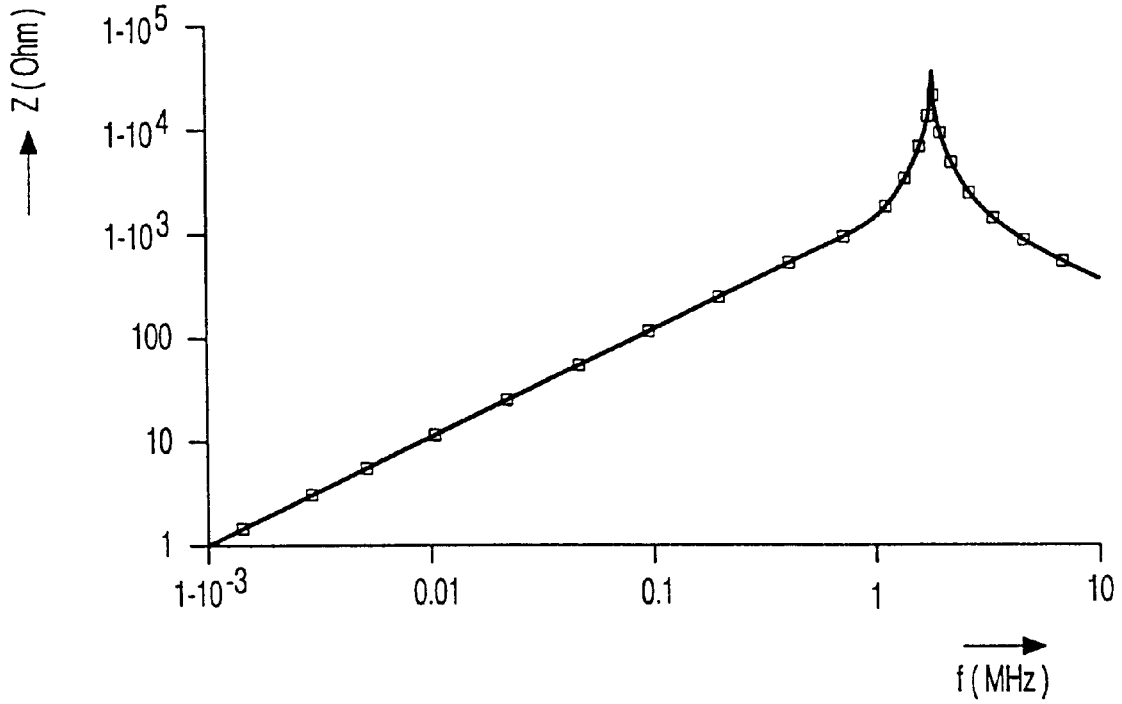
FIG. 5 graphically shows the impedance of a line deflection coil system as a function of the frequency.
Figure 6:
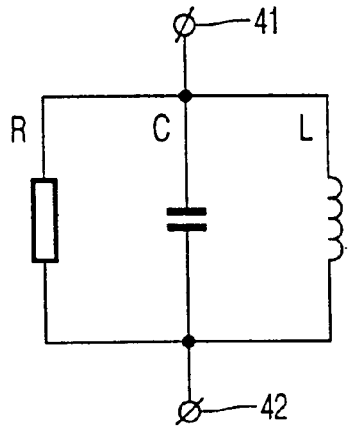
FIG. 6 shows an equivalent-circuit diagram for a line deflection coil system.

FIG. 5 shows the impedance of a known line deflection coil system as a function of the frequency. The impedance Z (in Ohm) is plotted on the vertical axis, the frequency f (in MHz) is plotted on the horizontal axis. The impedance curve exhibits a sharp peak at approximately 2 MHz. The squares indicate measured values, the curve indicates a calculated value for an equivalent circuit diagram as shown in FIG. 6. In said Figure, the reference numerals 41 and 42 represent connection terminals of the line deflection coil system. The drawn line shown in FIG. 5 indicates the impedance, as a function of the frequency, for a diagram as shown in FIG. 6, where R=34.6 kOhm, L=170 $\mu$H and C=48 pF.

Figure 7:
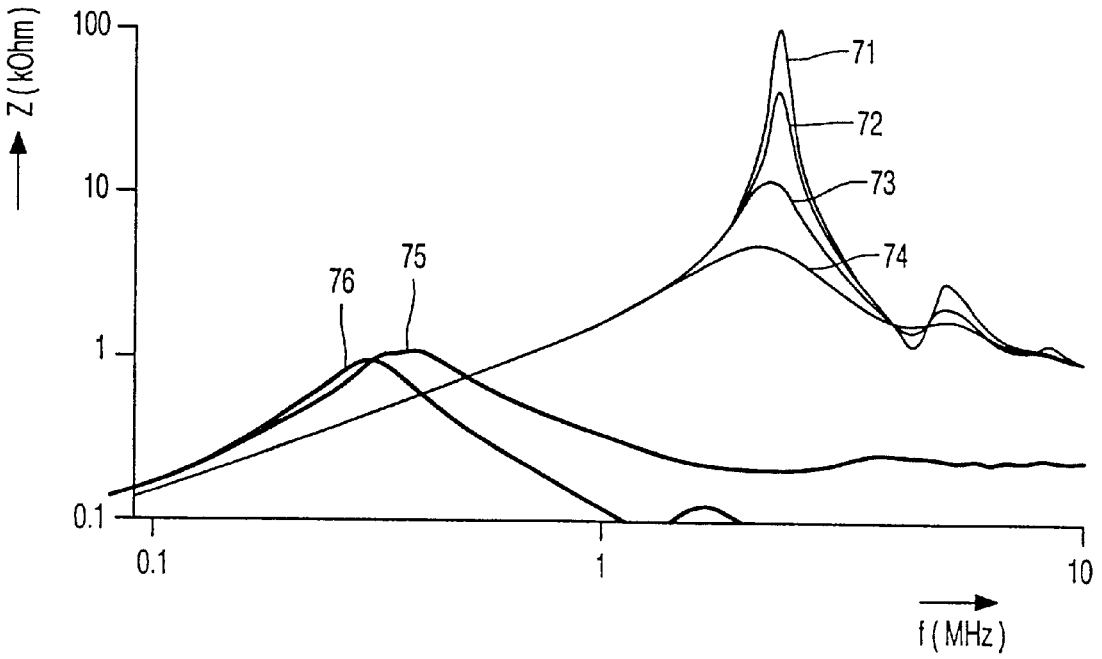
FIG. 7 shows the impedance of a line deflection coil system as a function of the frequency for application of different conductive layers.

FIG. 7 illustrates the effect of the application of a conductive layer on the line deflection coil system, in this example a line deflection coil system in which C=26 pF and L=200 $\mu$H. In all cases, the central part 21 (see FIG. 2B) of both line deflection coils is covered with a conductive layer. Of these conductive layers, the surface resistance is measured when they are provided on a glass plate. Curve 71 shows the impedance in the absence of a conductive layer. For curves 72, 73, 74, 75 and 76, the surface resistance of the conductive layer on a glass plate is, respectively, 500 MOhm/square, 0.5 MOhm/square, 0.1 MOhm/square, 0.01 MOhm/square and less than 1 Ohm/square. The values of $f_{max}/\Delta f$ are 16 (curve 71), 6.5 (curve 72), 3 (curve 73), 1 (curve 74), 1 (curve 75) and 1.5 (curve 76). The natural frequencies are 2.2 MHz (curve 71), 2.2 MHz (curve 72), 2.2 MHz (curve 73), 2 MHz (curve 74), 0.38 MHz (curve 75) and 0.31 MHz (curve 76). The natural frequencies for curves 75 and 76 are below 1 MHz, and an increased degree of ringing occurs. Curves 72, 73 and 74 illustrate embodiments in accordance with the invention, curves 73 and 74 showing preferred embodiments. Within the scope of the invention, the conductive layer may be applied in various ways. In a first way, a conductive material is provided in the adhesive layer of the wire used for winding the coils. During the formation of the line deflection coils, the adhesive layers melt together and a conductive layer is formed in and on the line deflection coils. For the conductive materials use can for example be made of carbon, organic conductive materials such as PEDOT or inorganic conductive materials such as ITO (indium tin oxide) or ATO. An alternative method of application consists in impregnating the deflection coils with a solution of a conductive material and, subsequently, allowing the solution to dry. The use of PEDOT, ITO or ATO solutions is preferred.

The impedance of the line or frame deflection coil system can be measured, for example, by means of a commercially available impedance analyzer such as the BP4192A. The measurement is carried out by connecting the connection wires of the relevant deflection coil system to the measuring apparatus (care should be taken, however, that apart from the deflection coil system no other elements (for example auxiliary coils or resistors are connected in series or in parallel) across the connection wires)). By means of such an apparatus, the impedance can be determined, for example, by applying a sinusoidal voltage and measuring the resultant current. The impedance is equal to the ratio between the voltage amplitude and the current amplitude.

The invention can be briefly summarized as follows:

A cathode ray tube includes a deflection unit. A coil system of the deflection unit is provided with a conductive layer, the value for $f_{max}/\Delta f$ ranging between 0.5 and 10, $\Delta f$ being the half-value width of the impedance curve around a peak frequency $f_{max}$, and $f_{max}$ being greater than 1 MHZ for a line deflection coil system and/or greater than 0.3 MHz for a frame deflection coil system. This results in a reduction of ringing phenomena.

What is claimed is:

1. A cathode ray tube comprising an electron gun, a display screen and a deflection unit for deflecting the electron beam, which deflection unit includes a line deflection coil system and a frame deflection coil system, characterized in that the line deflection coils are at least partly provided with a conductive layer, and the impedance of the line deflection coil system exhibits a maximum at a frequency $f_{max}$ of more than 1 MHz, and in that $f_{max}/\Delta f$ ranges between 0.5 and 10, $\Delta f$ being the half-value width of the impedance curve around $f_{max}$ and/or in that the frame deflection coils are at least partly provided with a conductive layer, and the impedance of the frame deflection coil system exhibits a maximum at a frequency $f_{max}$ of more than 0.3 MHz, and in that $f_{max}/\Delta f$ ranges between 0.5 and 10.

2. A cathode ray tube as claimed in claim 1, characterized in that $f_{max}/\Delta f$ ranges between 1 and 5.

3. A cathode ray tube as claimed in claim 1, characterized in that the conductive layer includes carbon.

4. A cathode ray tube as claimed in claim 1, characterized in that the conductive layer includes PEDOT.

5. A cathode ray tube as claimed in claim 1, characterized in that the conductive layer includes ITO or ATO.

6. A line deflection coil system, characterized in that the line deflection coils are at least partly provided with a conductive layer, and the impedance of the line deflection coil system exhibits a maximum at a frequency $f_{max}$ of more than 1 MHz, and in that $f_{max}/\Delta f$ ranges between 0.5 and 10, $\Delta f$ being the half-value width of the impedance curve around $f_{max}$.

7. A frame deflection coil system, characterized in that the frame deflection coils are at least partly provided with a conductive layer, and the impedance of the frame deflection coil system exhibits a maximum at a frequency $f_{max}$ of more than 0.3 MHz, and in that $f_{max}/\Delta f$ ranges between 0.5 and 10, $\Delta f$ being the half-value width of the impedance curve around $f_{max}$.

* * * * *